United States Patent [19]

Oliveri

[11] 4,103,145

[45] Jul. 25, 1978

[54] HAIR CURLING IRON AND OVEN

[76] Inventor: Joseph T. Oliveri, 6520 Palos Verdes Dr., East, Rancho Palos Verdes, Calif. 90274

[21] Appl. No.: 598,800

[22] Filed: Jul. 24, 1975

[51] Int. Cl.[2] ..... H05B 1/00; A45D 1/20; A45D 4/12

[52] U.S. Cl. ..... 219/222; 132/9; 132/33 R; 132/37 R; 219/242; 219/521

[58] Field of Search ..... 132/34 R, 7, 9, 37 R, 132/37 A, 31 R, 31 A, 32 R, 32 A, 33 R, 33 A, 33 B, 33 C, 33 D, 33 G, 39, 40, 118; 219/222–226, 533, 521, 230, 242

[56] References Cited

U.S. PATENT DOCUMENTS

| | | | |
|---|---|---|---|
| 161,313 | 3/1875 | Wilkinson | 132/33 R |
| 407,439 | 7/1889 | Hawkridge | 132/37 R |
| 498,986 | 6/1893 | Meyers | 219/225 UX |
| 530,787 | 12/1894 | Moore | 132/34 R |
| 1,061,289 | 5/1913 | Heyder | 219/242 UX |
| 1,069,164 | 8/1913 | Nilson | 219/222 UX |
| 1,388,805 | 8/1921 | Dennis | 132/37 R |
| 1,579,476 | 4/1926 | Dominguez | 219/242 UX |
| 2,051,763 | 8/1936 | Braunagel | 219/222 UX |
| 2,550,295 | 4/1951 | Price | 132/37 R |
| 3,430,816 | 3/1969 | Nadherney et al. | 219/242 UX |
| 3,516,420 | 6/1970 | Porter | 132/7 |
| 3,922,521 | 11/1975 | Viegut et al. | 219/222 |
| 3,946,196 | 3/1976 | Waters et al. | 219/222 |

FOREIGN PATENT DOCUMENTS

| | | | |
|---|---|---|---|
| 805,247 | 8/1936 | France | 132/33 D |
| 2,165,989 | 8/1973 | Fed. Rep. of Germany | 132/37 R |
| 343,440 | 9/1936 | Italy | 132/37 R |

*Primary Examiner*—A. Bartis

*Attorney, Agent, or Firm*—Romney, Schaap, Golant, Scillieri, Disner & Ashen

[57] ABSTRACT

A hair curling device having an oven with a plurality of downwardly tapered heating chambers for receiving one or more hair curling irons. A clamp is pivotally mounted on the insulated handle of the curling iron so that the forward end of the clamp can be moved from an open position displaced from the forward heat conductive end of a forwardly tapered cone to a closed position abutting the cone throughout its length. A stop member on the forward end of the cone facilitates the retention of the hair during the curling process. The heating chamber has an open ended bore to enable the stop member to pass therethrough.

11 Claims, 12 Drawing Figures

HAIR CURLING IRON AND OVEN

The present invention relates generally to hair curling devices for men's and women's hairstyling and, more specifically, to a hair curling iron having a forwardly tapered cone with an overlying clamp, both of which can be inserted in an oven member when not in use, and which can be removed from the oven so as to be completely separate and independent of any heating elements during the curling operation.

Curling irons have been used for years to administer heat to strands of hair which are held in a curved position, thus providing a permanent wave or curl when the hair is returned to its normal temperature. In order to achieve curls of various sizes it has been necessary in the past to use a number of differently-sized curlers or alternatively a number of differently-sized curling irons around which the hair is wrapped and held in position during the heating process.

It is a primary object of the present invention to eliminate the need for maintaining an inventory of numerous curlers and curling irons of different sizes and shapes, and instead to provide a universal curling iron capable of achieving the full range and shapes of curls.

It is another object of the present invention to provide a curling iron which is disengageable from a separate heating oven, so that the curling iron includes no heat generating elements, and requires no electrical connection cord or the like to be attached during the curling operation.

A more specific object of the present invention is to provide a curling iron having a forwardly tapered heat conductive cone in combination with a longitudinal clamp which overlies a portion of said cone along its length and provide an actuating arm pivotally mounted on a rear insulated handle portion of the curling iron for manual actuation by the same hand holding the curling iron itself.

A more specific object is to provide a device having the aforementioned characteristics wherein the person operating the curling iron can easily and safely manipulate the clamp between its open and closed position relative to the underlying cone, from any and all hand positions on the insulated rearward handle of the curling iron.

Another specific object of the invention is to provide an oven member for receiving a plurality of curling irons which have cooled down or which are not in use, and to provide a base plate on the oven for mounting the oven on either the horizontal or vertical support surface with the curling iron extendible from the heating chamber at an optimum angle for removal and insertion.

Additional objects and purposes and advantages of the present invention will be apparent to those skilled in the art in view of the following disclosure of a preferred embodiment of the invention.

IN THE DRAWINGS

Figure 12:
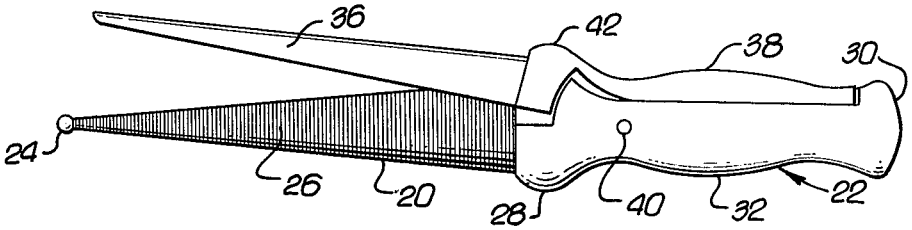
FIG. 12 is a side view of an alternate form of curling iron with the clamp in fully open position relative to the cone.

Referring to the preferred embodiment shown in the drawings, the hair curling device includes a curling iron having a forwardly tapered cone 20 made of heat conductive material which is connected at its rearward end to an insulated handle 22. The maximum and minimum diameter portions of the cone and the various diameters therebetween enable variable-diameter hair curling from a single iron. In the preferred form, the cone 20 is a unitary member of homogeneous material to provide even heating throughout its length, and includes an enlarged protrusion or ball 24 at its forward end to prevent small diameter curls from slipping off the cone during the curling process. An alternate embodiment, as shown in FIG. 12, includes circumferential grooves 26 which also facilitate the proper positioning of the hair during the curling process. Although a solid cone is shown, a hollow construction may also be used.

Since the handle 22 is normally held in one hand only, it is normally contoured to provide for easy handling and manipulation by the hairdresser. In that regard, the forward end of the handle constitutes an enlarged ring 28 to provide a clear definition of the forward boundary of the handle as well as to protect the hand from undesirable contact with the cone 20 itself. In the preferred form, optimum handling and manipulation was accomplished by providing an enlarged butt end at the rear, with an interior portion between the ring 28 and the end 30 of a relatively smaller diameter, with a slightly enlarged middle portion 32. The handle 22 is mounted to the cone 20 through a junction which serves as a dividing line between the heated conical portion and the insulated handle portion. Proper balancing can usually be achieved by varying the relative weights and lengths of the handle and the cone. In the illustrated form, the cone 20 was designed to be longer than the handle 22. Additionally, it was found preferable to taper the cone forwardly at a constant diminishing rate to provide a full range of sizes and shapes for hair curls. The handle 22 is connected to the cone 20 by a suitable fastener, such as a threaded insert assembly 34 located at the rear end of the cone 20.

In order to fully control the positioning of the hair on the cone 20, a heat conductive clamp 36 having approximately the same length as the curling portion of the cone 20 is sized and shaped for overlying a portion of the cone 20. Close conformity is provided by having the width of the clamp taper from a wide portion at the rear of the cone to a narrow portion at its forward end. Manual manipulation of the clamp 36 between a closed position against the cone 20 to an open position displaced laterally from the cone is accomplished by an actuating arm 38 of insulating material which is mounted at a pivot 40 to the handle 22. In order to provide suitable displacement of the clamp 36 from the cone 20 at its enlarged rearward end, the pivot 40 is preferably located rearwardly from the junction between the handle and the cone. In the exemplary embodiment, this places the pivot 40 behind the enlarged protective ring 28 of the handle.

In order to facilitate optimum manipulation of the actuating arm 38, it was found preferable to mount it in a slot so that the outer portion of the actuating arm has a size and shape conforming to the adjacent size and shape of the handle 22. Thus, when the actuating arm 38 is manually depressed to raise the clamp to an open position, the outer edge of the actuating arm 38 is substantially aligned with and flush relative to the adjacent portion of the handle 22. Similarly, the forward portion of the actuating arm 38 constitutes an enlarged diameter ridge 42 conforming to the adjacent ring 28 on the handle 22 of the cone, with the ridge 42 providing a sufficiently large area in which to embed the rearward portion 44 of the clamp 36 in the arm 38. The actuating arm 38 is preferably biased upwardly to hold the clamp 36 in a normally closed position against the cone 20, by means of a biasing spring such as the leaf spring 46 which is folded back on itself and inserted in the slot between the handle 22 and the overlying actuating arm 38. In the exemplary form, the slot for receiving spring 46 and the actuating arm 38 terminates short of the butt end 30 of the handle 22.

In order to provide an enlarged contact surface for manipulating the actuating arm 38, the width of the arm is preferably enlarged in the area behind the pivot 40 adjacent the enlarged diameter area of the handle. In the illustrated form, the contact width is diminished in the location adjacent to the butt end 30 of the handle 22 where the handle 22 is of lesser diameter.

It will be appreciated by those skilled in the art that the hair curling iron described above and shown in the drawing provides a simplified, well-balanced, easily made device which can be adeptly manipulated by variously sized hands in variously placed positions, while at the same time sliding and turning the hair at the chosen diameter along the cone 20 and under the overlying clamp 36.

Figure 1:
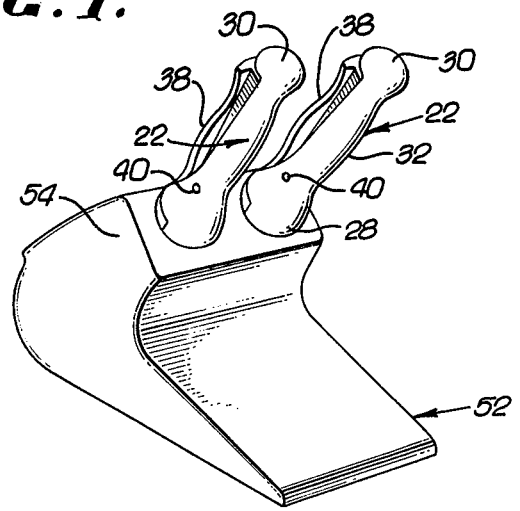
FIG. 1 is a perspective view showing the presently preferred embodiment of the invention, with two curling irons inserted in an oven mounted on a horizontal surface.
Figure 2:
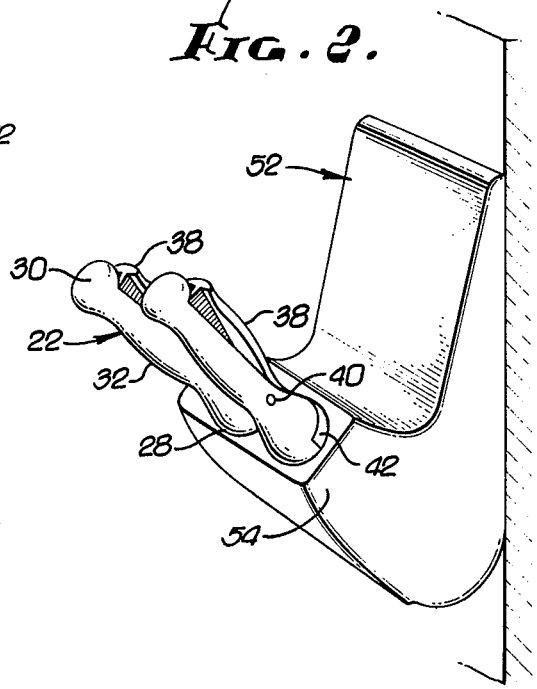
FIG. 2 shows a perspective view of the embodiment of FIG. 1 mounted on a vertical support surface.
Figure 3:
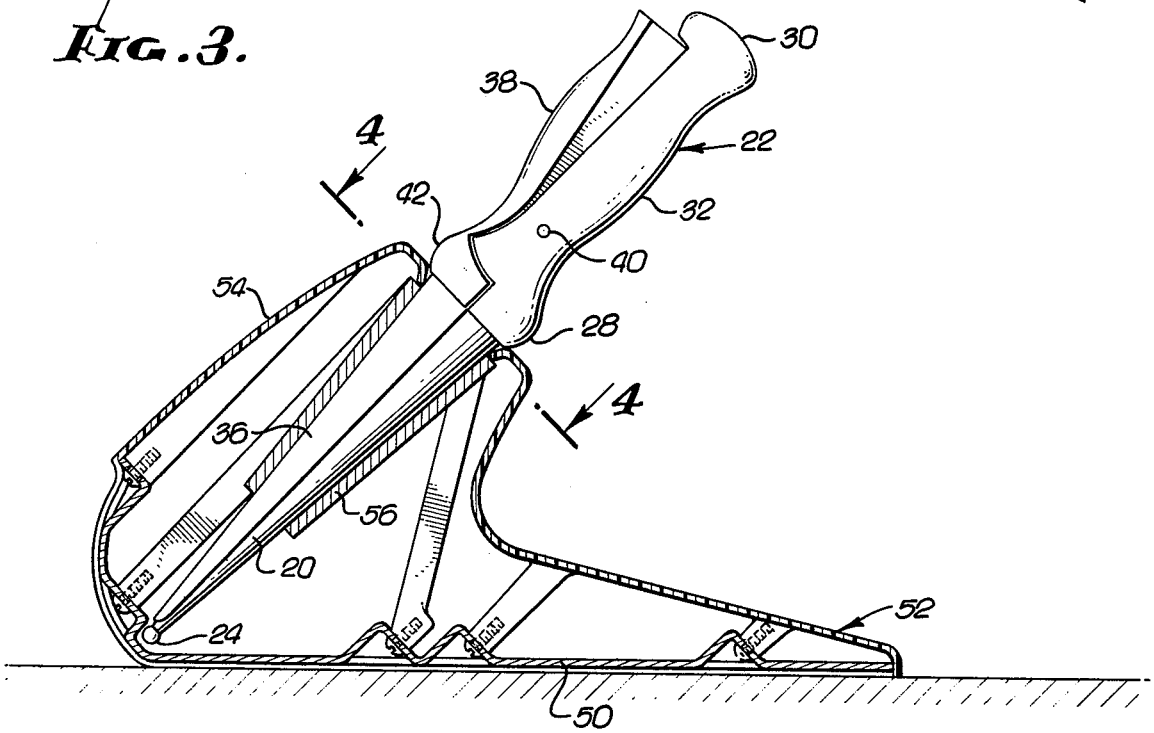
FIG. 3 shows a sectional view of the oven and one of its heating chambers with a curling iron inserted therein.
Figure 4:
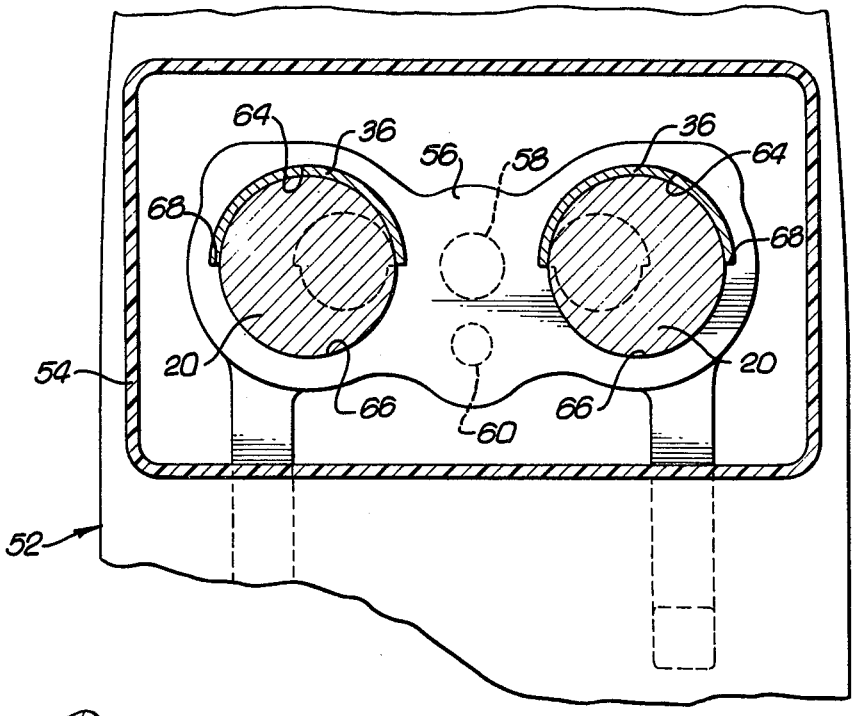
FIG. 4 is a sectional view taken along the line 4—4 in FIG. 3.
Figure 5:
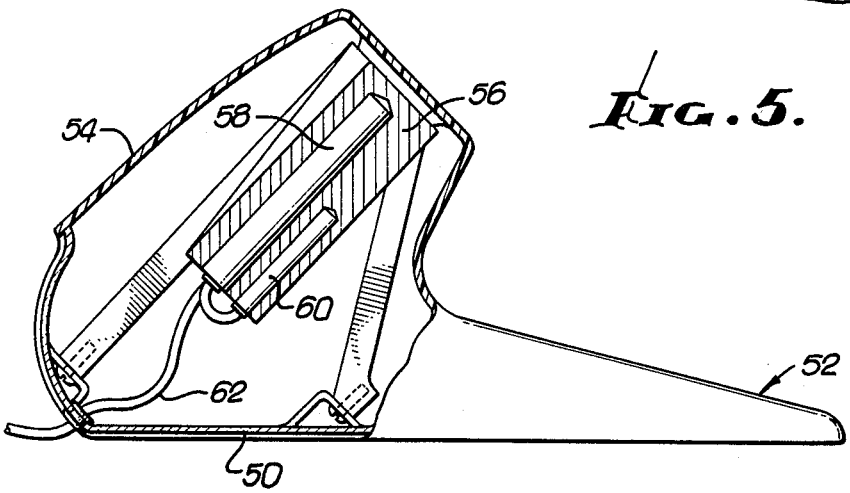
FIG. 5 is a sectional view of the oven taken through the middle section having the heating elements therein.
Figure 6:
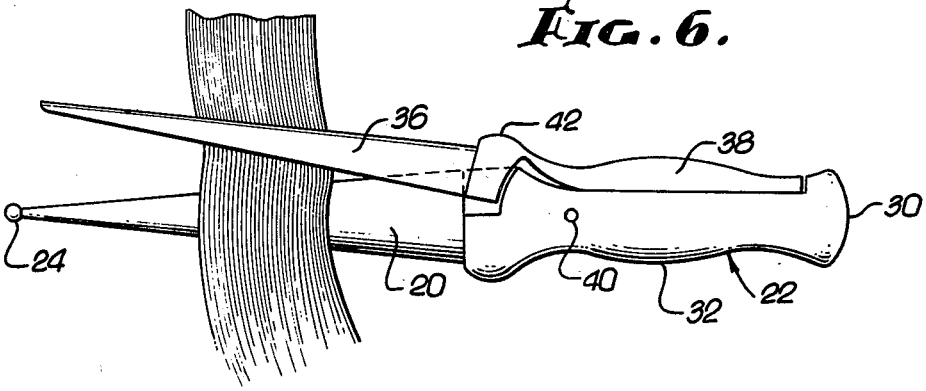
FIG. 6 is a side view showing the clamp in fully open position relative to the cone with a strand of hair therebetween.
Figure 7:
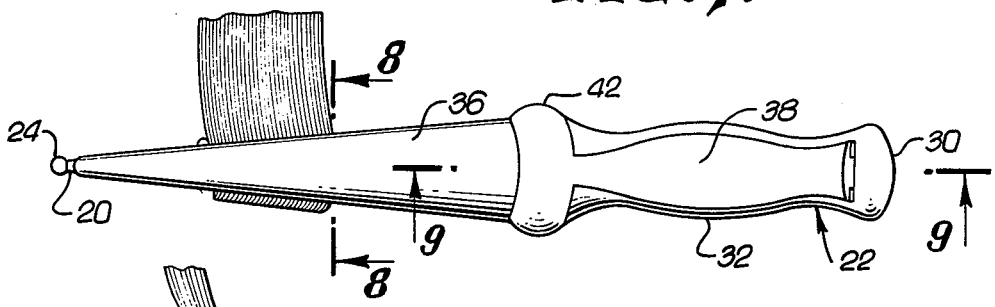
FIG. 7 is a top view showing the clamp in partially open position relative to the cone, with the strand of hair therebetween.
Figure 8:
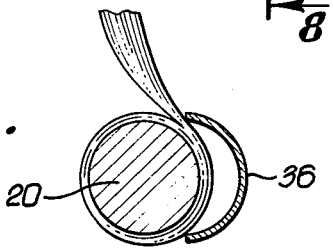
FIG. 8 is a cross sectional view taken along the line 8—8 in FIG. 7.
Figure 9:
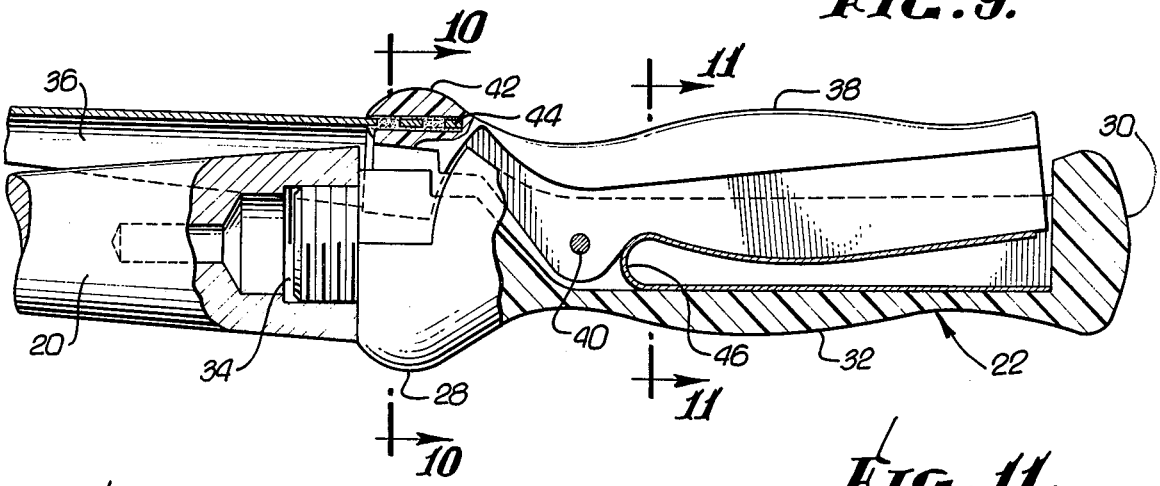
FIG. 9 is a longitudinal section view taken along the line 9—9 of FIG. 7.
Figure 10:
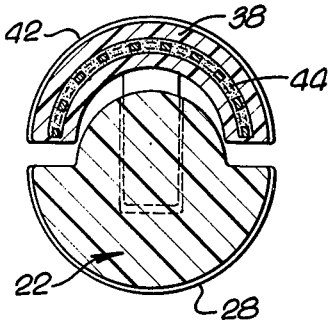
FIG. 10 is a cross sectional view taken along the line 10—10 of FIG. 9.
Figure 11:
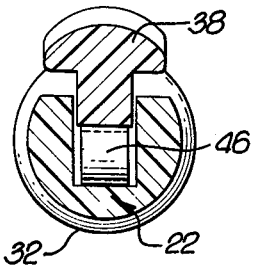
FIG. 11 is a cross sectional view taken along the line 11—11 of FIG. 9.

Of course, even if it is deemed advisable to attach an energy cord to the device during use, the resulting unit may still include the basic structural features recited above, without departing from the spirit and scope of the invention. The preferred form includes an oven having a base plate 50 for mounting against a horizontal (see FIG. 1) or vertical (see FIG. 2) surface. An insulated casing 52 includes an upwardly extending portion 54 which includes one or more openings to an interior chamber portion designed for receiving the cone 20 of the curling iron. More specifically, a heat conductive wall member 56 is attached to the casing 52 to form one or more downwardly tapered chambers for receiving the cone. In the illustrated form, two chambers are provided in a single unitary conducting member having large and small heating elements 58 and 60, respectively, in between said chambers to provide small and large temperature variations. Energy is provided through cord 62 from an external energy source (not shown). A variable temperature control may be provided on the oven to achieve different predetermined temperatures for the curling irons. The manner of simultaneously or selectively energizing the heating elements 58, 60 to achieve a predetermined oven temperature is well known in the art and is not claimed as an essential part of the invention. Accordingly the conventional electrical circuitry used for activating such heating elements is not shown.

The chambers in the oven are designed to receive both the cone 20 and the clamp 36 in closed position. In this regard, maximum heat conduction is obtained by providing an enlarged diameter portion 64 for contacting substantially the entire outer surface of the clamp 36 and a smaller diameter portion 66 for contacting the exposed outer portion of the cone. The resulting flange 68 in each of the chambers also serves as an orientation guide so that the hair curling device is always in the same position, e.g. with the actuating arm on top, whenever it is being heated or is being stored during non-use. Moreover, the hot cone 20 is protected against injurious contact when the curling iron is not in use.

It will be appreciated that by making the axial reference line of each oven chamber positioned at an acute angle relative to base plate 50, the curling iron will naturally slip by gravity into the chamber with little or no effort. Moreover, by making the acute angle a preferred 45°, an optimum position is obtained by mounting the oven on either a horizontal or vertical surface. Additionally, as shown in the preferred embodiment, by making a plurality of chambers, one curling iron can be heated to a preferred temperature for immediate use as soon as the second curling iron has lost undue heat through use.

It will thus be understood from the foregoing description, with reference to the appropriate drawings, that quick and even heating is obtained for each curling iron when not in use with only minimal effort by the hairdresser, thus allowing the hairdresser to concentrate on the primary job of styling the hair. Moreover, if desired, such hair styling can be done with a single iron unencumbered by an electrical cord or heat generating element attached to or within the curling iron itself.

Although exemplary embodiments of the invention have been disclosed for illustrative purposes, it will be understood that various changes, modifications and substitutions may be incorporated in such embodiment without departing from the invention as defined by the claims hereinafter.

I claim as my invention:

1. A hair styling iron comprising in combination:

a curling iron including a heat conductive cone mounted at a first junction to an insulated handle, and tapered from a first large diameter rear portion adjacent said handle to a second smaller diameter front portion;

a stop member on the forward end of the cone including hair positioning means diametrically larger than and extending outwardly from said smaller diameter front portion for preventing small diameter curls from slipping off the cone during the curling process;

a clamp including a heat conductive forward end shaped to fit against the outside of said cone, and connected through a second junction to a rear insulated actuating arm; and attachment means coupled between said curling iron and said clamp for movably connecting said clamp to said curling iron such that manual manipulation of said arm moves said forward end of said clamp between a closed position against said cone to an open position displaced from said cone to position the hair rearwardly of said stop member and between said clamp and said cone.

2. The device of claim 1 wherein said attachment means includes a pivot point interconnecting said clamp to said iron, and spring means for biasing said clamp to a normally closed position.

3. The device of claim 2 wherein said pivot point is located rearwardly from said first and second junctions to enable the rear portion of said clamp to be moved to an open position displaced outwardly from said cone.

4. The device of claim 2 wherein said actuating arm includes a contact surface which is displaced above the adjacent handle portion of said iron when said clamp is in said normally closed position, and which extends between the forward and rearward ends of the handle to be substantially flush with the adjacent handle portion of said iron when said clamp is in said open position.

5. The device of claim 2 wherein said handle portion between said first junction of said pivot point has an enlarged diameter relative to the handle portion behind said pivot point.

6. The device of claim 1 wherein said cone includes circumferential grooves extending around said cone.

7. The device of claim 1 wherein said clamp is tapered from a wide back portion to a narrow front end terminating short of said stop member.

8. In the combination of a hair curling iron heated by a matching oven, wherein the curling iron includes a heat conductive cone mounted at a first junction to an insulated handle, and tapered from a first large diameter rear portion adjacent said handle to a second smaller diameter front portion, with a stop member on the forward end of the cone including hair positioning means diametrically larger than and extending outwardly from the smaller diameter front portion, the improvement comprising:

an oven member for heating said curling iron, said oven member having an insulated casing having an opening in a wall therof, and downwardly extending heat conductive wall means formed from a unitary casting having an open ended tapered bore formed therein, said wall means attached to and extending inwardly of said casing from said opening and the bore thereof being so shaped as to receive and abut said cone and being so sized to allow the forward end of said cone and said stop member to pass through and protrude from said bore to transfer heat directly to said cone from said wall means when said cone portion of said curling iron is inserted through said opening into abutting engagement with said wall means, and further including means associated with said oven member for heating said wall means.

9. The combination of claim 8, wherein said oven includes a plurality of said wall means for heating a plurality of curling irons.

10. The combination of claim 8, wherein said curling iron includes a clamp overlying a portion of said cone, with said wall means in the oven including a first diameter portion for engaging said clamp and a smaller second diameter portion for engaging the exposed portion of said cone for contacting and transferring heat to said conical curling iron and clamp.

11. A hair styling device comprising in combination:

a curling iron including a heat conductive cone mounted at a first junction to an insulated handle, and tapered from a first large diameter rear portion adjacent said handle to a second smaller diameter front portion;

a stop member on the forward end of the cone including hair positioning means diametrically larger than and extending outwardly from said smaller diameter front portion for preventing small diameter curls from slipping off the cone during the curling process;

a clamp including a heat conductive forward end shaped to fit against the outside of said cone, and connected through a second junction to a rear insulated actuating arm;

attachment means coupled between said curling iron and said clamp for movably connecting said clamp to said curling iron such that manual manipulation of said arm moves said forward end of said clamp between a closed position against said cone to an open position displaced from said cone to position the hair rearwardly of said stop member and between said clamp and said cone; and an oven member for heating said curling iron, said oven member having an insulated casing having an opening in a wall thereof, and downwardly tapered heat conductive wall means attached to and extending inwardly of said casing from said opening and being so shaped as to receive and abut said cone and said clamp to transfer heat directly to said cone and clamp from said wall means when said cone portion of said curling iron is inserted through said opening into abutting engagement with said wall means, and further including means associated with said oven member for heating said wall means.

* * * * *